United States Patent [19]

Dunaway

[11] Patent Number: 5,058,879

[45] Date of Patent: Oct. 22, 1991

[54] DOCUMENT PRODUCTION HAVING JAM SHUTDOWN AND CLEARING STRATEGY

[75] Inventor: David L. Dunaway, New York, N.Y.

[73] Assignee: Eastman Kodak Company, Rochester, N.Y.

[21] Appl. No.: 548,693

[22] Filed: Jul. 5, 1990

[51] Int. Cl.[5] ..... B65H 7/02

[52] U.S. Cl. ..... 271/259

[58] Field of Search ..... 271/258, 256, 259, 261, 271/265, 291, 298; 355/319

[56] References Cited

U.S. PATENT DOCUMENTS

| | | | |
|---|---|---|---|
| 4,231,567 | 11/1980 | Ziehm | 271/259 |
| 4,264,187 | 4/1981 | Rhodes | 355/319 |
| 4,750,020 | 6/1988 | Ishizu et al. | 355/145 H |
| 4,786,041 | 11/1988 | Acquaviva et al. | 271/259 |
| 4,816,872 | 3/1989 | Okamoto et al. | 355/319 |
| 4,827,356 | 5/1989 | Yamamoto et al. | 358/302 |
| 4,878,428 | 11/1989 | Watarai | 101/484 |

FOREIGN PATENT DOCUMENTS

| | | | |
|---|---|---|---|
| 137367 | 10/1981 | Japan . | |
| 0122856 | 5/1989 | Japan | 271/258 |
| 2035967 | 6/1980 | United Kingdom | 271/259 |

*Primary Examiner*—H. Grant Skaggs

*Attorney, Agent, or Firm*—Milton S. Sales

[57] ABSTRACT

Document production apparatus has a receiver sheet source, an output to which a plurality of completed production documents are supplied in a predetermined sequence, and a path between the source and the output for in-process receiver sheets. The apparatus includes a receiver sheet jam condition detector for inhibiting delivery, to the output, of only those in-process receiver sheets which (1) can not be completed due to the jame condition or (2) could be completed regardless of the jam condition but which if completed would be supplied to the output out of sequence because of the inability to complete at least one other receiver sheet due to the jam condition.

3 Claims, 2 Drawing Sheets

DOCUMENT PRODUCTION HAVING JAM SHUTDOWN AND CLEARING STRATEGY

BACKGROUND OF THE INVENTION

1. Technical Field

This invention relates generally to an improved strategy for clearing paper jams in document production apparatus.

2. Background Art

Document production apparatus, which includes copiers and printers, commonly employ several shutdown procedures depending on the cause of the shutdown. For example, a normal shutdown is invoked at the end of a successful run, and is started as soon as the last image of the run has been written to the apparatus. On the otherhand, a so called hard shutdown is invoked when a catastrophic condition occurs which may damage the apparatus; and receiver sheet movement is stopped; at least upstream of the problem. A soft shutdown is invoked when a problem occurs which allows all successfully fed receiver sheets to continue processing until finished.

Many conventional types of document production apparatus employ jam recovery procedures which maintain the integrity of the run in progress while receiver sheet jams are cleared. The procedures allow the production run to restart at the position where the trouble was encountered.

Often, attempts are made to design the system to minimize the operator involvement in clearing the jam. For example, U.S. Pat. No. 4,878,428, issued to Watarai on Nov. 7, 1989, and Japanese 56-137367 of Oct. 27, 1981, disclose document copiers wherein a jam in the receiver sheet feeder section stops only the transport in that section, allowing continued operation of the sheet transport section down-stream of the sheet feeder section until all sheets which were fed from the paper supply before the jammed sheet was fed have been ejected. In another example of the prior art, U.S. Pat. No. 4,231,567 provides for sheets downstream of the jam to continue to the exit tray, and sheets upstream of the jam to proceed to a cluster area for easier clearance.

Recent document production concepts involve an electronic front end and capability for two-sided (duplex) document productions. Such apparatus would handle jobs with any sequence of page types, e.g., one-sided (simplex) or two-sided. The corresponding variations in receiver sheet path impose constraints on exposure timing. These constraints, along with the need for collated output, efficient frame utilization, and high throughput rate lead to schemes for judicious scheduling of exposures according to the page type sequence of a particular job.

An efficient schedule's exposure order is almost always different from the desired (collated) output page order. With a multi-page electronic image buffer on the electronic front end, this unnatural exposure order should present little difficulty. If the sequence of page types is known at the start of the job, a customized exposure schedule can be computed to complete the job in minimum time.

For example, commonly assigned, co-pending U.S. patent application Ser. No. 07/430,037 discloses a reproduction apparatus having a duplex turn-around path requiring a plurality of skip-frames between first and second sides of a duplex page. This suggests that the first side image may be scheduled for exposure and transfer even before a simplex page which is to precede the duplex page in the collated document set has been exposed. By the time the duplex receiver sheet has been transported around the duplex path and returned for the second side, the simplex page has been produced. This situation complicates jam shutdown procedures since a jammed sheet may be preceded by a sheet which will actually follow the jammed sheet in the finished document set.

DISCLOSURE OF INVENTION

It is an object of the present invention to provide document production apparatus with a purge area for clustering, in the event of a jam, in-process pages which either could not be completed due to the jam condition, or could be completed regardless of the jam condition but which if completed would be out of sequence because of the inability to complete at least one other page.

According to the above object, the present invention provides document production apparatus having a receiver sheet source, an output to which a plurality of completed production documents are supplied in a predetermined sequence, and a path between the source and the output for in-process receiver sheets. The apparatus includes means for detecting receiver sheet jam conditions, as well as means for inhibiting delivery, to the output, of only those in-process receiver sheets which (1) can not be completed due to the jam condition or (2) could be completed regardless of the jam condition but which if completed would be supplied to the output out of sequence because of the inability to complete at least one other receiver sheet due to the jam condition.

The invention, and its objects and advantages, will become more apparent in the detailed description of the preferred embodiments presented below.

BRIEF DESCRIPTION OF THE DRAWINGS

In the detailed description of the preferred embodiments of the invention presented below, reference is made to the accompanying drawings, in which.

BEST MODE FOR CARRYING OUT THE INVENTION

Figure 1:
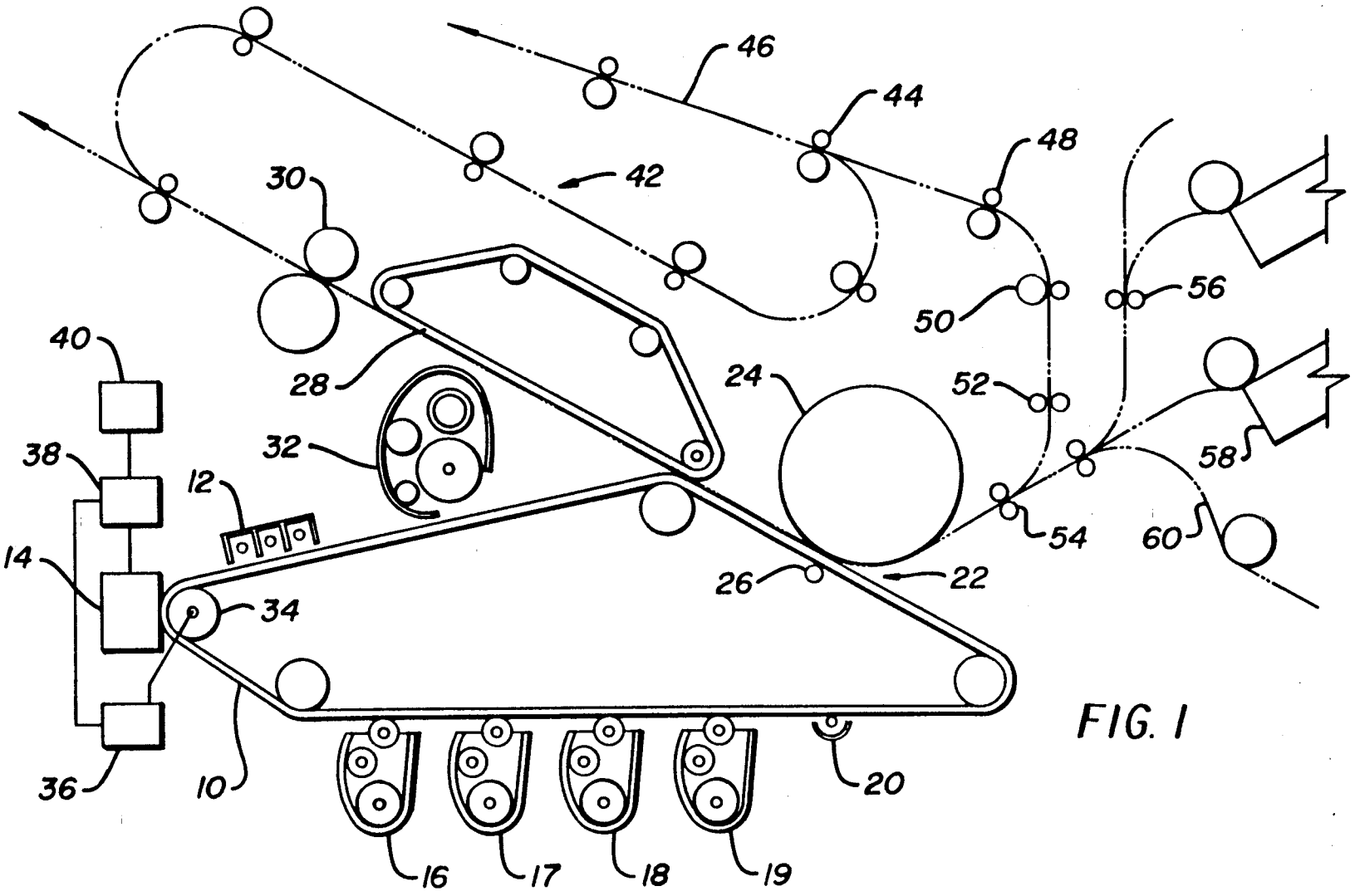
FIG. 1 is a schematic side view of a marking engine constructed according to the present invention, with many parts eliminated for clarity of illustration.

According to FIG. 1, a film core portion of a copier or printer includes an image member, for example, an endless electrophotoconductive web 10. Web 10 is driven through a series of electrophotographic stations generally well-known in the art. More specifically, a uniform charge is laid down on web 10 by a charging station 12 before the charged web moves to an LED printhead 14.

The web then moves into operative relation with a series of toning or developing stations 16, 17, 18 and 19. Each image created by printhead 14 is toned by one of the toning stations. After being toned, the web passes a magnetic scavenger 20 which removes excess iron particles picked up in the toning process. The toner image then proceeds to a transfer station 22 where the image is transferred to a transfer surface of a receiver sheet carried by a transfer drum 24.

Transfer drum 24 cooperates with web 10 to incrementally bring the receiver sheet and the toner image into transfer relation. As is well known in the art, this is generally accomplished in the presence of an electric field which is created by biasing the transfer drum by a suitable biasing means compared to the conductive layer of web 10 or to a backing roller 26 for the web. As discussed in U.S. Pat. No. 4,712,906, when the apparatus is operating in a multi-image mode, for example, a multicolor mode, consecutive images are toned with different colored toners using the different toning stations 16–19. These consecutive images are transferred in registry to the receiver sheet as it repeatedly is brought into transfer relation with web 10 by drum 24.

After the transfer operation is complete, the receiver sheet is allowed to follow the web. The receiver sheet is separated from the web with the aid of an electrostatic sheet transport mechanism 28 and is transported to a fuser 30. The web is then cleaned at a station 32.

A sprocket on printhead roller 34 is linked to an encoder 36. The encoder feeds signals indicative of the angular position of roller 34 to a drive 38 for printhead 14, which drive 38 times the application of information from an information source 40 to the printhead.

After the receiver sheet leaves fuser 30, it can go directly to an output tray or finisher, not shown, or be deflected by suitable means into a duplex path as controlled by the logic of the apparatus. The duplex path moves the sheet by rollers and guides along a lower duplex path 42, directing it first through a passive deflector into the nip of reversing turn-around rollers 44. Turn-around rollers 44 are independently driven to drive the receiver sheet into turn-around guide means 46 until the trailing edge thereof has been sensed by an appropriate sensor, not shown, to have passed the diverter. Once the trailing edge has passed the diverter, turn-around rollers 44 are reversed and the receiver sheet is driven by rollers 44 and other sets of drive rollers 48 and 50 through a refeed area to duplex refeed rollers 52 upstream of transfer station 22. The receiver sheet can pass through registration mechanisms for correcting for skew, crosstrack misalignment and intrack misalignment and ultimately stop at registration feed rollers 54.

Transfer station 22 receives sheets from any of several sources: manual feed and upper cassette rollers 56, a second cassette 58, a main feed 60 and the duplex path. The receiver sheets from whatever source stop against registration feed rollers 54. In response to a signal from the logic and control of the apparatus, not shown, registration feed rollers 54 accelerate to drive the receiver sheet into the nip between transfer drum 24 and web 10 as the first toner image to be transferred approaches the nip.

The duplex path is of a length that takes multiple receiver sheets at one time depending on the length of the sheets. For example, four letter size sheets or two ledger size sheets may be in the duplex path at one time. If the printer is printing different images on different sheets, the logic and control of the apparatus must supply the necessary programming to the exposure and toning stations so that the sheets ultimately fed to the output tray are in the correct order considering the number of sheets that must be in the duplex path. Such programming is known in the art, see, for example, U.S. Pat. No. 4,453,841.

As in many types of document production apparatus, receiver sheet feed and advancement through its path must be stopped upon detection of certain conditions. Some such conditions are normal, such as for example, at the end of a successful document production run. Other conditions are considered to be abnormal. Abnormal conditions can themselves be divided into levels; from potentially catastrophic when a receiver sheet jams in a fuser or fails to strip from web 10, to less severe when an out-of-toner alarm is received from one of development stations 16–19.

Different problem conditions call for different levels of shutdown. For example, a normal shutdown is invoked at the end of a successful document production run, and is started as soon as the last image of the run has been input to the marking engine. A hard shutdown is invoked when a catastrophic condition occurs which may damage the marking engine, and all receiver sheets are stopped in place. A soft shutdown is invoked when a problem occurs, and allows all receiver sheets which have been successfully fed into the marking engine to continue processing until finished, although some images written to web 10 may not be processed because the corresponding receiver sheet had not been fed at the time of the problem occurrence.

A sequenced shutdown mode has also been provided for allowing a cycle down of the marking engine at a convenient point in the sequencing algorithm when the cause of the shutdown is not related to paper handling problems and where immediate shutdown of any of the rollers is not required. Such a cause might, for example, include out-of-toner alarms or fuser related problems. In effect, the sequenced shutdown mode provides for the complete processing of all images written to web 10 by printhead 14 and of all receiver sheets fed from the paper supplies. A sequenced shutdown might include additional images being written to web 10 to service receiver sheets already fed, or the feeding of additional receiver sheets for images already written to the web at the time the shutdown is initiated.

Figure 2:
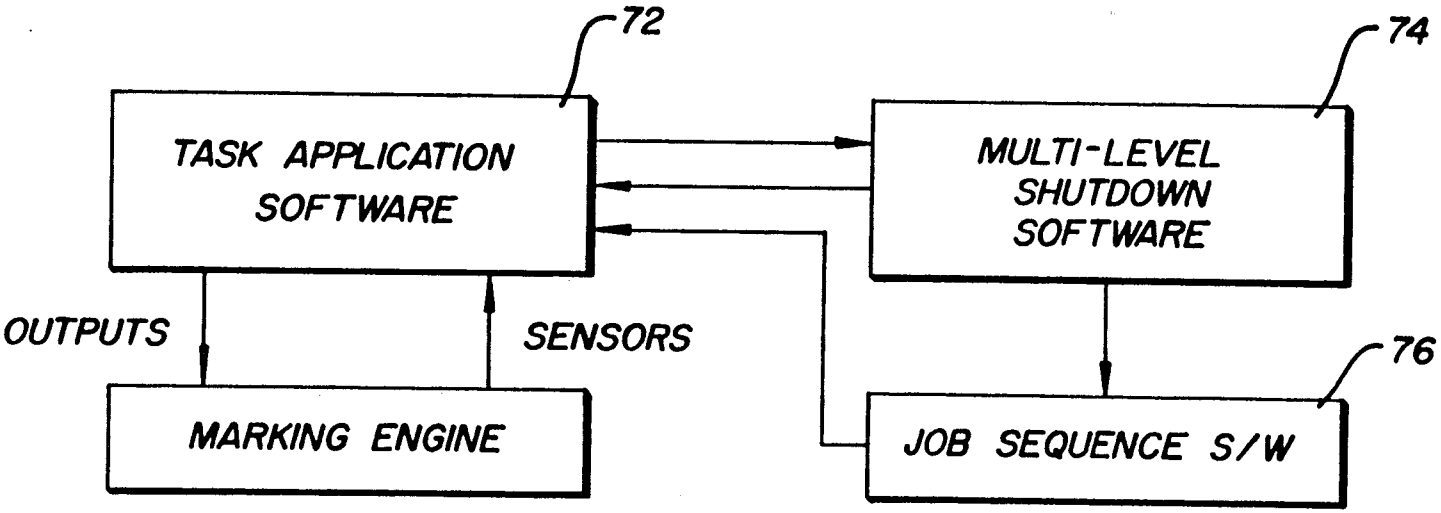
FIG. 2 is a schematic block diagram of software architecture associated with the marking engine of FIG. 1.

Referring to FIG. 2, when task application software 72 detects a problem or condition, it calls for a particular level shutdown. Multi-level shutdown software 74 performs the shutdown and provides information to job sequence software 76 so that the sequencer can properly recover after the problem has been eliminated.

Preferably, the rollers of the receiver sheet path are clutched or have drive independence from the marking engine main drive, and are controlled by logic signals, so that each of the simplex, lower duplex, upper duplex, and paper supply subpaths can be isolated from the other subpaths. Of course, the simplex subpath is necessary to deliver finished receiver sheets to the output tray.

A firm shutdown is invoked in the event of a paper handling problem in the duplex refeed subpath or in the area of registration feed roller 54. All receiver sheets in lower duplex subpath 42 are fed into turn-around guide means 46, which becomes a purge area for clustering receiver sheets. Only simplex pages and completed (both sides) duplex pages which are downstream of the jam at the time of the firm shutdown are deemed to be finished and permitted to proceed to the exit tray. Duplex pages with only one side transferred are directed to the purge area.

If a shutdown occurs because of a jam or misfeed in the sheet supply region of manual feed and upper cassette rollers 56, second cassette 58, or main feed 60, it is physically possible to complete any sheet. previously supplied. These previously supplied sheets, if completed, could be delivered to the exit tray and deemed finished. However, differences in the simplex and duplex sheet paths, and the associated exposure scheduling scheme, could result in a completed duplex page being delivered to the exit tray out of proper page order.

Accordingly, the present invention provides not only that sheets that cannot be completed due to the jam condition be delivered to the purge area, but also that sheets that could be completed regardless of the jam but which if completed would be supplied to the exit-tray out of page order because of the inability to complete at least one other page due to the jam, be delivered to the purge area.

By this improvement, an operator can clear a jam, remove sheets from the purge area and other locations around the paper path, and restart the apparatus without concern that the document set being produced will be improperly collated.

Although the present invention has been described in detail with particular reference to preferred embodiments, it is understood that variations and modifications thereto can be effected within the scope and spirit of such invention.

What is claimed is:

1. Document production apparatus having a receiver sheet source, an output to which a plurality of completed production documents are supplied in a predetermined sequence, and a path between the source and the output for in-process receiver sheets, the improvement comprising:

means for detecting receiver sheet jam conditions;

means for inhibiting delivery during a jam condition, to the output, of only those in-process receiver sheets which (1) can not be completed due to the jam condition or (2) could be completed regardless of the jam condition but which if completed would be supplied to the output out of sequence because of the inability to complete at least one other receiver sheet due to the jam condition; and means for continuing production and delivery, to the output, of all other in-process receiver sheets.

2. Document production apparatus having a receiver sheet source, an output to which a plurality of completed production documents are supplied in a predetermined sequence, and a path for in-process receiver sheets between the source and the output, the improvement comprising:

a receiver sheet jam condition detector;

a purge area for clustering receiver sheets upon detection of a jam condition, whereby the clustered receiver sheets can be easily removed;

means for clustering during a jam condition in said purge area those in-process receiver sheets which (1) can not be completed due to the jam condition or (2) could be completed regardless of the jam condition but which if completed would be supplied to the output out of sequence because of the inability to complete at least one other receiver sheet due to the jam condition; and means for continuing production and delivery, to the output, of all other in-process receiver sheets.

3. Document production apparatus having a receiver sheet source path, a transfer station whereat images are transferred to receiver sheets fed from the source path, a duplex path for receiving duplex receiver sheets after an image is transferred to one side and for re-presenting the duplex receiver sheet to the transfer station to receive an image on the other side of the duplex receiver sheet; and apparatus comprising:

means for detecting receiver sheet jams in the receiver sheet source path;

means for inhibiting delivery during a jam condition, to the output, only those in-process receiver sheets which (1) can not be completed due to the jam condition or (2) could be completed regardless of the jam condition but which if completed would be supplied to the output out of sequence because of the inability to complete at least one other receiver sheet due to the jam condition; and means for continuing production and delivery, to the output, of all other in-process receiver sheets.

* * * * *